United States Patent [19]

Gowda et al.

[11] Patent Number: 4,789,028

[45] Date of Patent: Dec. 6, 1988

[54] ANTI-VIBRATION BARS FOR NUCLEAR STEAM GENERATORS

[75] Inventors: Byre V. Gowda, Youngwood; Robert M. Wilson, Plum Boro; Robert M. Wepfer, Wilkinsburg, all of Pa.

[73] Assignee: Westinghouse Electric Corp., Pittsburgh, Pa.

[21] Appl. No.: 51,160

[22] Filed: May 15, 1987

Related U.S. Application Data

[62] Division of Ser. No. 670,728, Nov. 13, 1984, abandoned.

[51] Int. Cl.[4] ..... F28D 7/16

[52] U.S. Cl. ..... 165/162; 29/157.3 R; 29/523; 29/421.1; 138/173; 165/69

[58] Field of Search ..... 29/523, 421 R, 157.3 R; 138/173, 177; 165/162, 69, 172; 376/448; 122/511, 493, DIG. 13, 510

[56] References Cited

U.S. PATENT DOCUMENTS

| | | | |
|---|---|---|---|
| 239,514 | 3/1881 | Leadley | 138/173 X |
| 1,928,009 | 9/1933 | Dormier | 138/177 |
| 3,201,861 | 8/1965 | Fromson et al. | 29/523 X |
| 3,585,540 | 6/1971 | Schuttloffel et al. | 138/177 X |
| 3,637,008 | 1/1972 | Michel et al. | 122/510 X |
| 3,864,811 | 2/1975 | Walker | 29/455 R |
| 3,964,873 | 6/1976 | Aramaki et al. | 138/177 X |
| 4,204,570 | 5/1980 | Eisinger | 165/162 X |
| 4,208,988 | 6/1980 | Jacobs et al. | 122/510 |
| 4,577,386 | 3/1986 | Faudou et al. | 29/455 |

FOREIGN PATENT DOCUMENTS

| | | | |
|---|---|---|---|
| 685848 | 1/1953 | United Kingdom | 165/162 |
| 1188564 | 4/1970 | United Kingdom | 165/162 |
| 1532100 | 11/1978 | United Kingdom | 165/162 |

*Primary Examiner*—Charlie T. Moon

[57] ABSTRACT

A method of forming and installing anti-vibration bars into a tube bundle of a steam generator is disclosed. The tube bundle comprises rows of tubes, each tube carrying a high temperature coolant. Each of the resultant anti-vibration bars has a tubular configuration and is disposed between adjacent rows of the tube bundle for stabilizing the tubes against vibration caused by fluids recirculating at high velocities through the steam generator. The method of this invention comprises the steps of inserting at least one anti-vibration bar between adjacent rows of the tube bundle and applying a pressurized fluid in the anti-vibration, thus expanding the anti-vibration bar to contact the tubes of the adjacent rows and to make a series of indentations therein. Typically, the pressure of the fluid is increased incrementally up to a maximum level set such that the configuration of the steam genrator tubes is not deformed. The resultant anti-vibration bar is a hollow member and has first and second series of indentations disposed on opposing sides thereof and spaced from each other a uniform distance corresponding to the spacing between adjacent tubes of a row. The indentations are configured similarly to the shape of the tubes to provide intimate contact there between and to support the tubes against vibration.

3 Claims, 4 Drawing Sheets

FIG. 2.
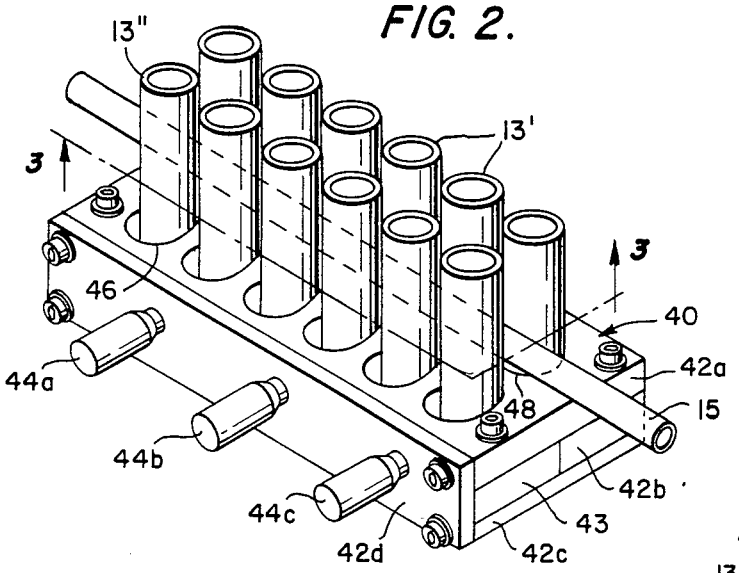
FIG. 4.
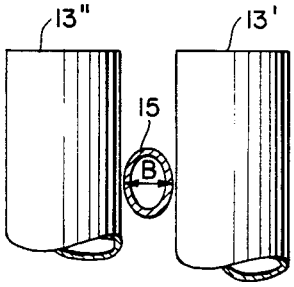
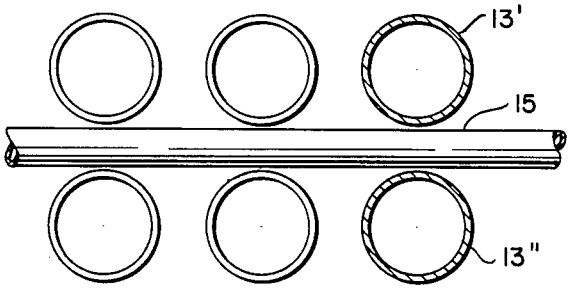
FIG. 3.
FIG. 6.
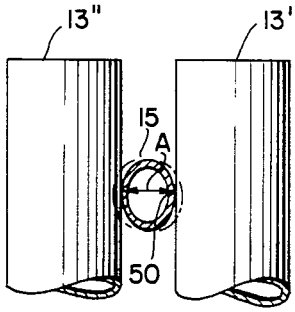
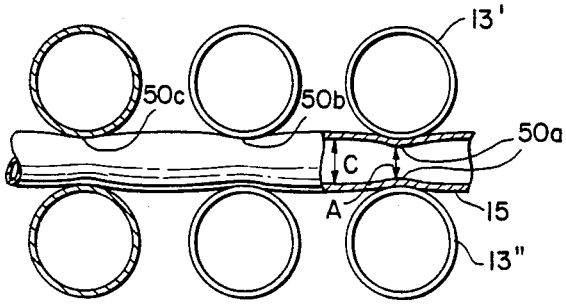
FIG. 5.

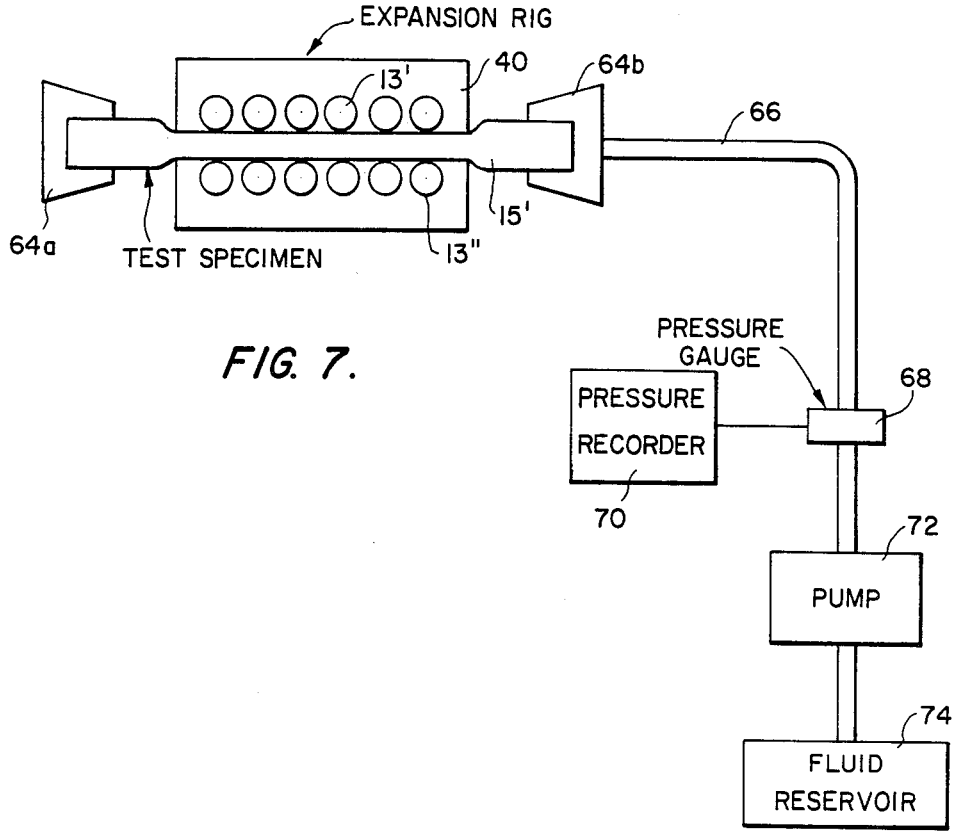
FIG. 7.
FIG. 8A.
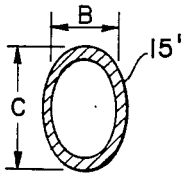
FIG. 9A.
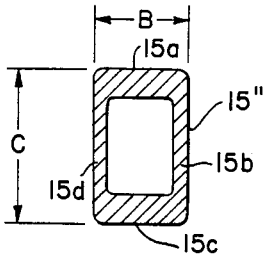
FIG. 10A.
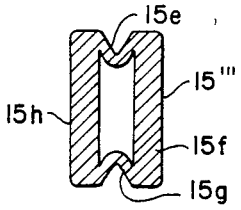
FIG. 8B.
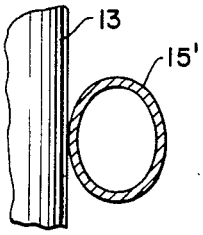
FIG. 9B.
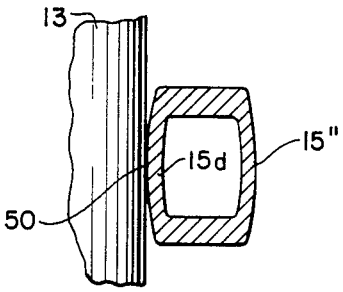
FIG. 10B.
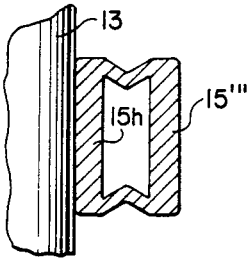

ANTI-VIBRATION BARS FOR NUCLEAR STEAM GENERATORS

This application is a division of application Ser. No. 670,728, filed Nov. 13, 1984, now abandoned.

BACKGROUND OF THE INVENTION

1. Field of the Invention

This invention relates to mechanisms for supporting the tubes of a nuclear steam generator to prevent vibration and, more particularly, to anti-vibration bars as disposed between rows of the tubes and the method of installing the anti-vibration bars to achieve reduced clearance with and thus support of such tubes.

2. Description of the Prior Art

A nuclear steam generator 8 of the type found in the prior art is shown in FIGS. 1A and 1B of the attached drawings, as comprising a bundle 11 of a large number of vertically oriented U-shaped tubes 13. The tubes 13 are disposed in a lower, cylindrically shaped shell 9 of the steam generator 8, whose bottom end is associated with a channel head 17, typically of a hemi-spherical configuration as shown in FIG. 1A. The channel head 17 is divided by a partition 18 into a first half typically known as a hot leg 20, and a second half typically known as a cold leg 22. The high-temperature coolant water from the nuclear reactor is introduced into the steam generator 8, through a primary coolant inlet 24 into the hot leg 20. The high-temperature coolant passes from the hot leg 20 into the exposed openings of the plurality of U-shaped tubes 13, passing there through to be introduced into the cold leg 22 and, finally, exiting from the steam generator 8 through a primary coolant outlet 26.

That portion of the steam generator 8, primarily including the tube bundle 11 and the channel head 22 is referred to as an evaporator section 10. As shown in FIG. 1A, the steam generator 8 further includes a steam drum section 32 comprising an upper shell 30, which contains a moisture separator 34. Feedwater enters the steam generator 8 through inlet nozzle 28 disposed in the upper shell 30 to be distributed and mixed with the water removed by the moisture separator 34. This feedwater travels down an annular channel surrounding the tube bundle 11 and is introduced into the bottom of the tube bundle 11. The mixture of feedwater and recirculating water boils as the high temperature coolant is circulated through the U-shaped tubes 13 of the tube bundle 11. The steam so produced rises into the steam drum section 32. The moisture separator 34 removes the entrained water from the steam before the steam exits from the steam generator 8 through a steam outlet 36 to a turbine separator (not shown).

As shown in FIG. 1A, the U-shaped tubes 13 are supported in the configuration of the tube bundle 11 by a series of lower tube supports 12 and an upper tube support plate 14. As shown in FIGS. 1A and 1B, the upper tube support assembly 14 comprises a plurality of retainer rings 16*a*, 16*b* and 16*c*. As best shown in FIG. 1A, each of the retainer rings 16 is of generally oval configuration. The major and minor diameters of the retainer rings 16*a*, *b* and *c* are progressively smaller, noting that the retainer 16*c* is disposed at the uppermost portion of the tube bundle 11. A plurality of sets of anti-vibration bars 15 is disposed between adjacent rows of the U-shaped tubes 13. One such set of anti-vibration bars 15 is shown in FIG. 1B, it being understood that successive sets of similar anti-vibration bars 15 are disposed behind and in front of the illustrated set. Each of the anti-vibration bars 15*a*, 15*b* and 15*c* is of a V-shaped configuration with the ends thereof extending to the circumference of the tube bundle 11 and connected to a corresponding one of the retainer rings 16. For example, one end of the anti-vibration bar 15*a* is secured as by tack-welding to the retainer ring 16*a* and, in similar fashion, the other end of the anti-vibration bar 15*a* is secured to the same retainer ring 16*a*. FIG. 1B illustrates a cross-sectional view taken through the tube bundle 11 showing that the anti-vibration bars 15*a*, 15*b* and 15*c* are disposed to support the upper ends of the U-shaped tubes 13, noting the arrangement of the U-shaped tubes 13*a* to 13*n* in a row.

This invention relates to a novel configuration and method of constructing such anti-vibration bars 15. Anti-vibration bars 15 are installed in the U-bend region of the tube bundle 11 to control tube vibration caused by the steam/water mixture flowing by the U-shaped tubes 13. In the absence of anti-vibration bars 15, the U-shaped tubes 13 would vibrate and, if not controlled, would leak resulting in the loss of the primary coolant into the steam supplied to the turbine generator.

Anti-vibration bars of the prior art are typically of uniform cross-section, e.g., square or cylinder. On the other hand, the U-shaped tubes 13 are of substantially uniform cylindrical cross-section with the result that there is a gap/clearance between the anti-vibration bars 15 and the U-shaped tubes 13. Gaps between the U-shaped tubes 13 and the anti-vibration bars 15 are not desirable for tube performance or from a reliability point of view and are difficult to make small. The U-shaped tubes 13 and the anti-vibration bars 15 have dimensioned tolerances and are assembled such that close contact there between is difficult to maintain. For example, normal tolerances occur in the outer diameters of the anti-vibration bars 15 and the U-shaped tubes 13. The forming of the U-shaped tubes 13 results in oval cross-sections in their bend areas and their straight portions may not be aligned precisely parrallel with each other. Further, the openings within the tube support plate 14 may not be precisely spaced so that the spacing between adjacent U-shaped tubes 13 in the region of their bends may not be uniform.

SUMMARY OF THE INVENTION

It is therefore an object of this invention to provide new and improved anti-vibration bars that have decreased clearance from the U-shaped tubes of a nuclear steam generator, whereby the degree of tube support is improved.

It is a more specific object of this invention to provide a new and improved method for installing anti-vibration bars between rows of U-shaped tubes in a manner that the contact surface of the anti-vibration bars is conformed to the configuration of the U-shaped tubes.

In accordance with these and other objects of this invention, this invention provides a new method of forming and installing anti-vibration bars into a tube bundle of a steam generator, the tube bundle comprised of rows of tubes, each tube carrying a high temperature coolant. Each of the anti-vibration bars has a tubular configuration and is disposed between adjacent rows of the tube bundle for stabilizing the tubes against vibration caused by fluids flowing through the steam generator. The method of this invention comprises the steps of inserting at least one anti-vibration bar between adjacent rows of the tube bundle and applying a pressurized fluid to the hollow anti-vibration bar, thus expanding the bar circumference to contact the tubes of the adjacent rows and to provide a series of contacts with minimum clearances. Typically, the pressure of the fluid is applied at a pressure sufficient such that the configuration of the steam generator tubes is not deformed. In one illustrative embodiment, the maximum pressure level has been found to be 5000 PSI. The resultant anti-vibration bar is a hollow member and has first and second series of contacts disposed on opposing sides thereof and spaced a uniform distance from each other corresponding to the spacing between adjacent tubes of a row. The contact spacings are minimized to provide effective support the tubes against vibration. Preferably, the anti-vibration bars are of an oval configuration with the first and second series of contacts aligned with the minor axis of the oval configuration.

BRIEF DESCRIPTION OF THE DRAWINGS

While the specification concludes with claims particularly pointing out and distinctly claiming the subject matter of the invention, it is believed that the invention will be better understood from the following description taken in conjunction with the accompanying drawings, wherein:

FIG. 2 is a perspective view of a test rig for receiving first and second rows of test tubes between which are disposed an anti-vibration bar;

FIGS. 3 and 5 show plan views of the rows of test tubes illustrating, respectively, an anti-vibration bar before and after deformation, whereas FIGS. 4 and 6 are side views respectively of the arrangements of FIGS. 3 and 5 showing the anti-vibration bar in cross-section;

FIG. 7 is a schematic diagram of the test rig of FIG. 2 as coupled to a controllable source of pressurized fluid;

FIGS. 8A and 8B show respectively an oval shaped anti-vibration bar and such a bar in contact with a U-shaped tube;

FIGS. 9A and 9B show respectively a second embodiment of this invention in the form of a hollow rectangularly shaped anti-vibration bar and the manner in which it contacts a U-shaped tube; and FIGS. 10A and 10B show respectively a third embodiment of this invention in the form of a rectangularly shaped anti-vibration bar with foldable side portions and the manner in which such a vibration bar contacts a U-shaped tube.

DESCRIPTION OF THE PREFERRED EMBODIMENT

Figure 1A:
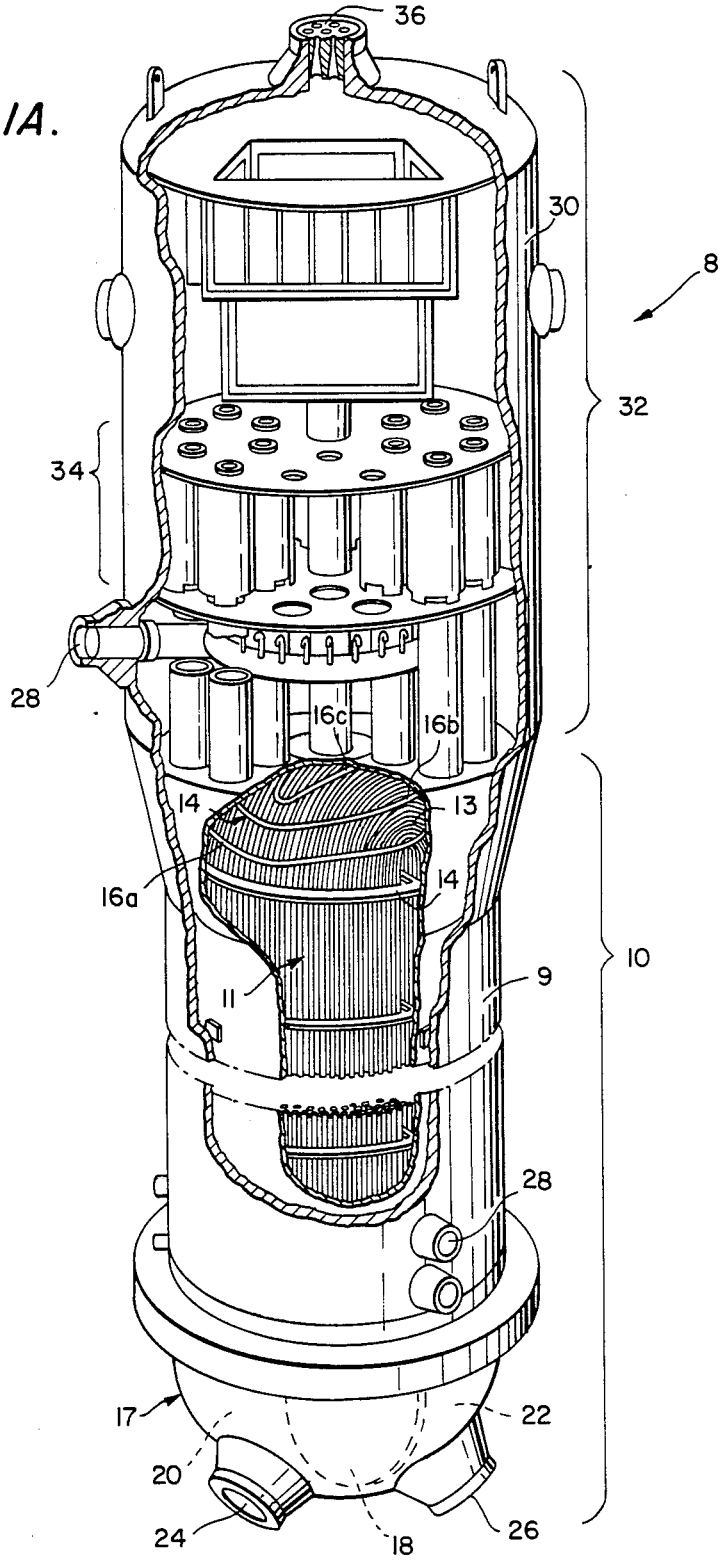
FIGS. 1A and 1B are respectively a perspective view of a nuclear steam generator, wherein its U-shaped tubes are supported by an upper tube support assembly in accordance with the teachings of this invention, and a cross-sectioned view particularly showing the anti-vibration bars of this invention and the matter in which they are assembled into the upper tube support assembly.
Figure 1B:
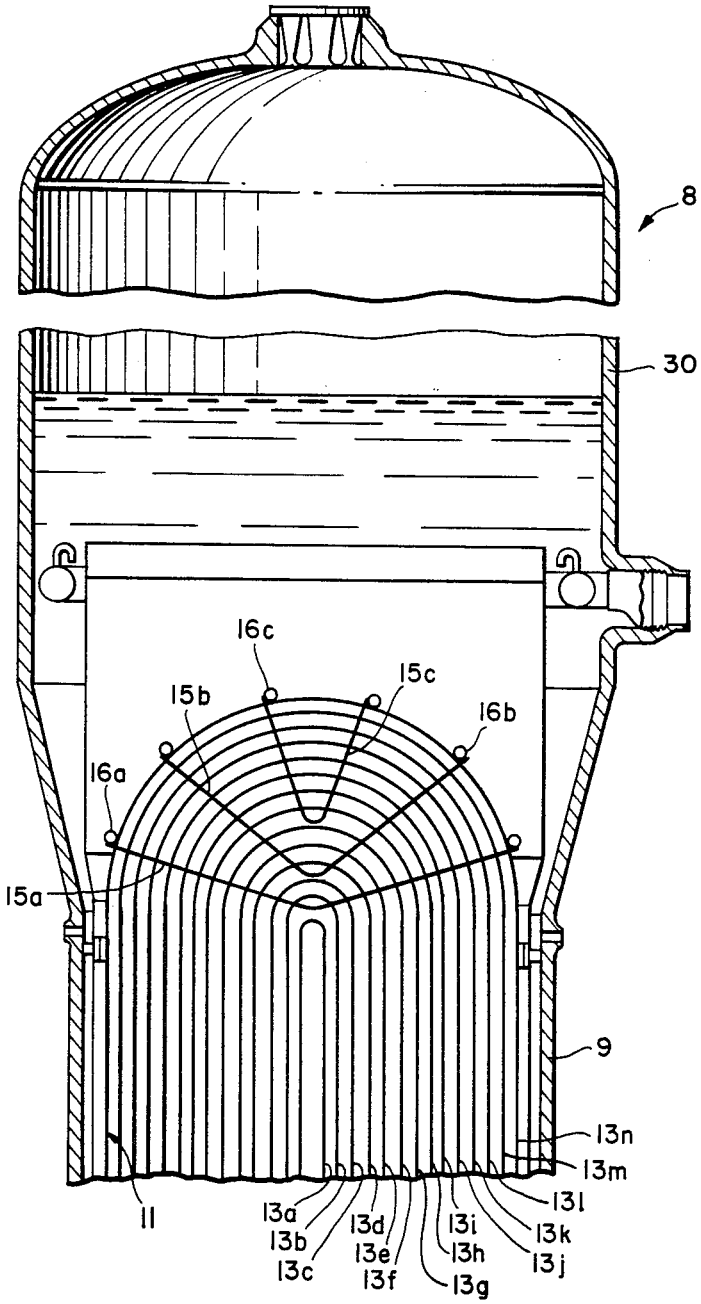

Referring now to the drawings and, in particular, to FIG. 2, there is shown a test rig 40 for receiving and imparting a series of indentations 50 to an anti-vibration bar 15. The test rig 40 comprises an upper plate **42*a*, front and back plates 42*d* and 42*b* and a lower plate 42*c*, rigidly held together by bolts as shown. The upper plate 42*b* has first and second rows of openings 46 and 48, for respectively receiving first and second rows of test tubes 13″ and 13′. As illustrated in FIGS. 2 and 3, the anti-vibration bar 15 is disposed between the first and second rows of test tubes 13′ and 13″. Each of the first set of openings 48 has a configuration and dimension substantially similar to those of the test tubes 13 for rigidly disposing the test tubes 13, whereas each of the second set of openings 46 is of substantially oval configuration to permit the second set of test tubes 13″ to be directed toward the first rows of test tube 13′ whereby the spacings between corresponding pairs of the test tubes 13′ and 13″ may be variably set, thus duplicating the inconsistent spacings between U-shaped tubes 13 of a typical tube bundle 11. As illustrated in FIG. 2, a set of micrometer heads 44*a*, 44*b* and 44*c* may be manually rotated to variably set the spacings between opposing test tubes 13′ and 13″**.

As shown in FIGS. 3 and 4, the oval-shaped, tubular anti-vibration bars 15 have initially a uniform minor diameter before they are compressed as will be explained. The anti-vibration bars 15 of this invention are tubular in character to permit their deformation by the application of fluidized pressure, whereby a minimum gap contact is achieved with the U-shaped tubes 13, thus improving the vibration support provided to these tubes 13. In particular as shown in FIG. 5, a series of indentations **50*a*, 50*b* and 50*c*, etc., is provided in the anti-vibration bar 15 by applying a pressurized fluid thereto. The diameter B along the minor axis of the oval-shaped anti-vibration bar 15 is shown in FIG. 4 before the application of pressure. As illustrated in FIGS. 5 and 6, opposing indentations 50*a*, 50*b*, 50*c*, etc., are imparted to the anti-vibration bar 15 and the minor diameter A of the anti-vibration bar 15 there between is slightly increased by the application of pressurized fluid with respect to the minor diameter B. The application of the fluidized pressure increases significantly the minor diameter C of the deformed anti-vibration bar 15 at a point approximately midway between adjacent indentations 50. It is realized that deformation may increase slightly the minor diameter A from the original minor diameter B. As particularly illustrated in FIG. 5, the surfaces of the indentations 50 tend to conform to the configuration of the opposing test tubes 13′ and 13″, whereby the size of the gaps between the anti-vibration bars 15 and the tubes is minimized. The minimized gap between the tubes and anti-vibration bars 15 improves the support provided by the anti-vibration bars 15 to the test tubes 13**, thereby reducing the vibration and the risk of primary coolant leakage. Maintaining the gap size at 3 mil or less is believed to result in the desired tube support and vibration reduction.

The mechanical deformation of anti-vibration bars 15 is carried out after the assembly and installation of the U-shaped tubes 13 as the tube bundle 11. In a preferred embodiment of this invention, method and apparatus are provided for a hydraulically deforming anti-vibration bars 15 as illustrated in FIG. 7. FIG. 7 illustrates an anti-vibration bar 15 dispose between first and second rows of the test tubes 13′ and 13″ as supported by the test rig 40 as explained above. A pump 72 supplies a regulated, pressurized fluid, such as water, to the anti-vibration bar 15, whereby the anti-vibration bar 15 is expanded and a series of indentations **50*a*, 50*b*, 50*c*, etc., as shown in FIG. 5, is imparted to the anti-vibration bar 15. It is understood that in the preferred method of compressing and installing the anti-vibration bars 15, that the U-shaped tubes 13 are first assembled into the tube bundle 11 as illustrated in FIGS. 1A and B, and thereafter the pump 72 is coupled sequentially or in other desirable order to each of the anti-vibration bars 15** to impart the desired deformation.

As shown in FIG. 7, the pump 72 is coupled by a conduit 64 and a fluid coupling 64*b* to the one end of the anti-vibration bar 15. The opposite end of the anti-vibration bar 15 is attached to a fluid coupling 64*a*, which serves to prevent the leakage of the pressurized fluid, thus serving to permit the increase of pressure within the anti-vibration bar 15. The pump 72, which may in one illustrative embodiment comprise a model S-440-60-SS as manufactured by SPRAGUE, pumps the fluid via the conduit 66 and coupling 64*b* to the anti-vibration bar 15. A pressure gauge 68 is coupled in circuit between the pump 72 and the anti-vibration bar 15, whereby a measurement of fluid pressure is obtained. Further, a pressure recorder 70 is connected to the pressure gauge 68, whereby a record of the fluid pressure may be kept, primarily, to ascertain the maximum fluid pressure. The pressure gauge 68 and the pressure recorder 70 may illustratively take the form of those models D-HS and LS-600-650 as manufactured by BLH and LINSEIS, respectively.

In an illustrative embodiment of this invention, an oval-shaped anti-vibration bar 15', as illustrated in FIGS. 8A and 8B, having a major diameter of 0.40 inches and a minor diameter of 0.30 inches was disposed between first and second rows 13' and 13'' as positioned by the test rig 40. Fluid pressure was established within the anti-vibration bar 15 and gradually increased by the pump 72 to a maximum pressure. Illustratively, the oval-shaped anti-vibration bar 15' may have a wall thickness of 0.02 inches and be made of that stainless steel known as type 304.

As illustrated in FIGS. 2 and 5, the pairs of test tubes 13' and 13'' are deposed at six locations 1, 2, 3, 4, 5, and 6, each pair spaced 1 inch from an adjacent pair. In order to demonstrate the feasibility of this method of deformation, the spacings of the tube pairs 1 to 6 were set respectively to be 0.372, 0.340, 0.372, 0.300, 0.372 and 0.300, as would simulate the variations and spacings found within the tubes 13 of a typical tube bundle 11. The pressure was incrementally raised by the pump 72 in steps of 500 PSI until a maximum of 5000 PSI was reached, before returning the pressure to 0. The following series of relatively uniformed diameters A and C resulted:

| Pressure, PSI | Diameter (inch) at Location | | | | | | | | | | |
|---|---|---|---|---|---|---|---|---|---|---|---|
| | 1 | 1–2 | 2 | 2–3 | 3 | 3–4 | 4 | 4–5 | 5 | 5–6 | 6 |
| 0 | .292 | .298 | .295 | .296 | .298 | .296 | .297 | .297 | .298 | .297 | .298 |
| 500 | .318 | .317 | .320 | .314 | .315 | .316 | .300 | .314 | .311 | .314 | .300 |
| 1000 | .331 | .344 | .340 | .344 | .329 | .341 | .300 | .339 | .320 | .335 | .300 |
| 1500 | .372 | .349 | .340 | .354 | .372 | .352 | .300 | .351 | .372 | .349 | .300 |
| 2000 | .372 | .369 | .340 | .369 | .372 | .364 | .300 | .364 | .372 | .362 | .300 |
| 2500 | .372 | .381 | .340 | .379 | .372 | .379 | .300 | .376 | .372 | .374 | .300 |
| 3000 | .372 | .386 | .340 | .388 | .372 | .386 | .300 | .384 | .372 | .381 | .300 |
| 3500 | .372 | .398 | .340 | .399 | .372 | .396 | .300 | .392 | .372 | .398 | .300 |
| 4000 | .372 | .400 | .340 | .401 | .372 | .402 | .300 | .399 | .372 | .404 | .300 |
| 4500 | .372 | .409 | .340 | .409 | .372 | .409 | .300 | .404 | .372 | .404 | .300 |
| 5000 | .372 | .410 | .340 | .411 | .372 | .412 | .300 | .409 | .372 | .409 | .300 |
| 0 | .372 | .394 | .340 | .389 | .372 | .395 | .300 | .384 | .372 | .387 | .300 |

Further, tests have shown that when the pressure is raised greater than a predetermiined maximum, e.g., 5000, for the particular oval-shaped anti-vibration bar 15', that the anti-vibration bar 15' may deform the cylindrical configuration of the tubes 13. Such deformation of the U-shaped tubes 13 may threaten their structural integrity, which must be avoided by limiting the predetermined maximum in view of the particular construction, e.g., material and dimensions, of the anti-vibration bar 15.

Referring now to 9A and 9B, there is shown a further embodiment of this invention, in which an anti-vibration bar 15'' is configured as a rectangle having relative thick top and bottom sides 15*a* and 15*c* as compared to side walls 15*b* and 15*d*. Dimensions B and C as shown in FIG. 9A are respectively 0.30 and 0.50 inches. FIG. 9B illustrates the anti-vibration bar 15'' after it was pneumatically expanded, whereby the side 15*d* is curved.

Referring now to FIGS. 10A and 10B, a third embodiment is illustrated, wherein anti-vibration bar 15''' has side walls 15*f* and 15*h* interconnected by flexible side walls 15*e* and 15*g*. The dimensions B and C are similar to those of the anti-vibration bar 15'' as shown in FIG. 9A. Of the three illustrative embodiments, the oval-shaped anti-vibration bar 15' is the preferred embodiment in that it is relatively easy and inexpensive to manufacture.

In considering this invention, it should be remembered that the provided disclosure is illustrative only and the scope of this invention should be determined by the appended claims.

We claim as our invention:

1. Anti-vibrations bars structurally supporting tubes carrying high temperature coolant in a steam generator, said anti-vibration bars being disposed between adjacent rows of tubes and expanded from a rest state to an expanded state as pressure is applied to the interior of said anti-vibration bars, each of said anti-vibration bars being configured as a hollow member of a rectangular shape, said rectangular shape comprising a pair of opposing wall lengths and a pair of opposing wall widths, each of said wall lengths have a thickness greater than that of said wall widths to facilitate expansion of said opposing wall lengths away from each other and into contact respectively with tubes of adjacent rows, said wall lengths having sufficient rigidity to resist deformation as said bars are expanded to their expanded state so that said wall lengths make a line contact with their respective tubes.

2. The anti-vibration bars as claimed in claim 1, each of said wall widths has a fold when said bars are in their rest state to facilitate expansion of said bars to their expanded state.

3. The anti-vibration bars as claimed in claim 1, wherein each of said wall widths has a thickness of approximately 0.02 inch.

* * * * *